United States Patent [19]

Ganiaris

[11] 3,949,486

[45] Apr. 13, 1976

[54] ORANGE JUICE

[75] Inventor: Neophytos Ganiaris, Riverdale, N.Y.

[73] Assignee: Struthers Scientific and International Corporation, New York, N.Y.

[22] Filed: Mar. 10, 1975

[21] Appl. No.: 556,833

[30] Foreign Application Priority Data

Mar. 8, 1974 United Kingdom ..... 10476/74

[52] U.S. Cl. ..... 34/5; 34/92

[51] Int. Cl.[2] ..... F26B 5/06

[58] Field of Search ..... 34/5, 92

[56] References Cited

UNITED STATES PATENTS

| | | | |
|---|---|---|---|
| 2,471,677 | 5/1949 | Flosdorf | 34/5 |
| 2,564,475 | 8/1951 | Fischer | 34/5 |
| 3,276,139 | 10/1966 | Togashi et al. | 34/92 |
| 3,365,806 | 1/1968 | Pfluger et al. | 34/5 |
| 3,381,302 | 4/1968 | Reimus et al. | 34/5 |
| 3,404,007 | 10/1968 | Muller | 34/5 |

*Primary Examiner*—John J. Camby

*Attorney, Agent, or Firm*—William A. Drucker

[57] ABSTRACT

A process is provided for the freeze concentration of a comestible product such as orange juice wherein a hard frozen mass of an extract thereof is heated and cooled alternately to soften and then reharden the mass, the hard mass is then granulated and dried under vacuum. The step of heating and cooling the hard frozen mass can be repeated for example between 2 and 8 times.

10 Claims, 2 Drawing Figures

ORANGE JUICE

BACKGROUND TO THE INVENTION

The invention relates to the freeze concentration of a comestible product, particularly orange juice.

SUMMARY OF THE INVENTION

According to the invention there is provided a process for the freeze concentration of a comestible product, comprising the steps of completely freezing an aqueous extract of a comestible product to form a hard frozen mass thereof, alternately raising and lowering the temperature to convert the hard frozen mass firstly into a soft frozen mass and then into another hard frozen mass, granulating the another hard frozen mass to obtain particles, and drying the particles obtained under vacuum.

When the invention is applied to orange juice in particular, it is preferable to remove some water from the juice prior to formation of the first hard frozen mass. This may be done by partially freezing the juice and removing the ice crystals so formed. It is advisable to filter the juice to remove orange pulp therefrom before partially freezing, and then returning the same pulp to the concentrated juice prior to freezing.

The step of warming and refreezing the hard frozen mass may be repeated a number of times. For orange juice at least two cycles and less than 8 cycles have been found to give a satisfactory result.

An embodiment of the invention will now be described purely by way of example with reference to the accompanying drawings in which:

DESCRIPTION OF THE PREFERRED EMBODIMENT

Figure 1:
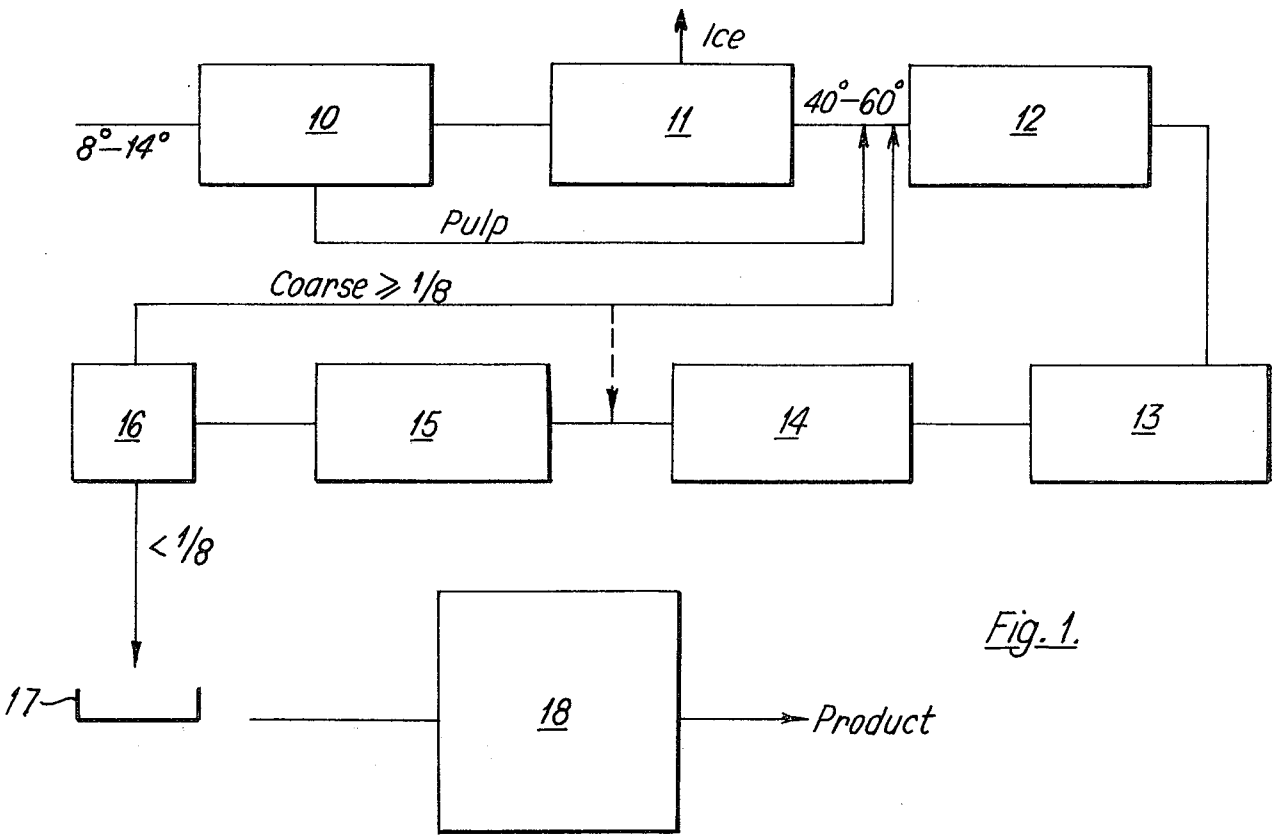
FIG. 1 shows diagrammatically a circuit diagram for a method of freeze concentrating orange juice according to the invention.
Figure 2:
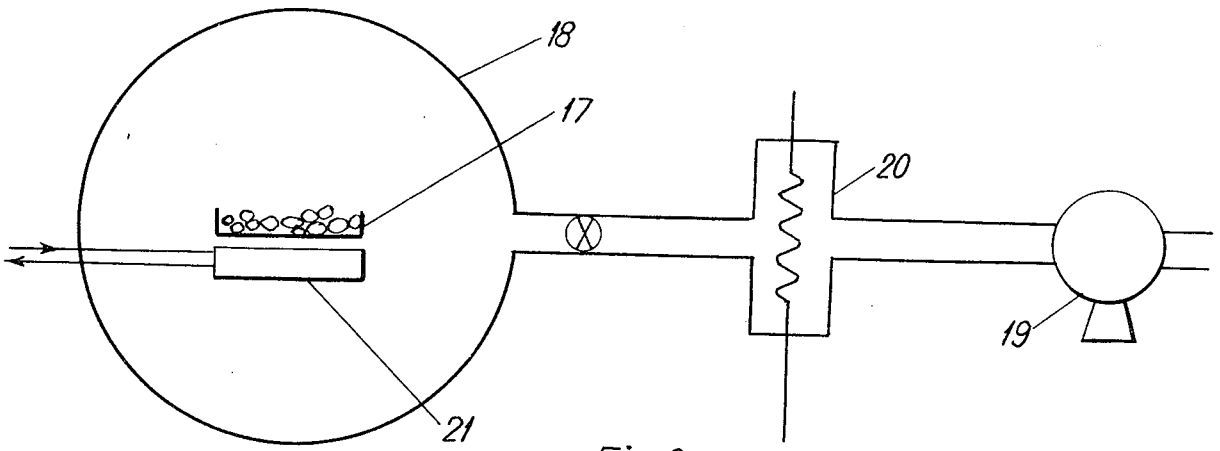
FIG. 2 shows diagramatically a vacuum chamber for use in the process described in connection with FIG. 1.

Referring to the Figures, freshly squeezed orange juice (8°–14°Brix) is fed to a pulp separator 10 where it is filtered to remove the orange pulp. It is then freeze concentrated to over 20°Brix and preferably in the range of 40°–60°Brix, in the device 11.

The concentrated orange juice (40°–60°Brix) is mixed again with orange pulp from the pulp separator 10, which pulp was removed prior to freeze concentration and then cooled slowly in a scrapped surface heat exchanger 12 or other device until it becomes a thick paste or slurry. This thick paste of orange juice, pulp and discrete ice crystals fed to the freezer 13 where it is cooled further to a temperature below −35°F and preferably in the range of −60°F to −80°F and kept at this temperature until it becomes a frozen solid mass.

The frozen material from the freezer 13 is passed to a treatment zone 14 where it is allowed to warm up to −35°F so becoming a soft frozen mass, which is then frozen again to become a hard frozen mass at −60°F to −80°F. This technique of warming and refreezing is utilized several times in order to insure that all the water has been frozen. For orange juice, the warming and refreezing should be done at least twice but not more than 8 times, preferably not more than 6 times.

After the final freezing, the hard frozen mass is fed to a granulator 15 at −60°F to −80°F and then screened. The particles from the screens 16 having an average diameter of less than ⅛ inches are loaded into trays 17 and the trays are transferred into a vacuum chamber 18. The coarse frozen particles from the screens 16 are recycled to the griding device or to the concentrated orange juice prior to freezing.

In the vacuum chamber 18, the pressure is lowered by means of a pump 19 to less than 100 microns and preferably in the range of 60 – 80 microns. The vacuum chamber is fitted with a condensor 20 the temperature of which is maintained at less than − 50°F and preferably −80°F – 100°F. Heating plates 21 which supply the required heat for the sublimation of ice from the particles are held at −20°F to −10°F for a period of 3–6 hours; then the temperature of the heating plates is increased gradually to about 32°F over a period of 3–6 hours and finally the temperature is increased to 80°F over a period of 1–2 hours. At the end of the cycle, the product is heated to 120° – 140°F for a few minutes, preferably less than 30 minutes.

The dried product removed from the vacuum chamber has a moisture content of less than 3 percent and preferably less than 1 percent. If the product is held for 30 minutes at 140°F, the moisture content is reduced to less than 1 percent.

We claim:

1. A process for the freeze concentration of a comestible product, comprising the steps of:

i completely freezing an aqueous extract of a comestible product to form a hard frozen mass thereof, ii alternately raising and lowering the temperature to convert the hard frozen mass firstly into a soft frozen mass and then into another hard frozen mass, iii granulating the another hard frozen mass to obtain particles, and iv drying the particles obtained under vacuum.

2. The process accordng to claim 1, wherein the extract is concentrated before completely freezing, by partially freezing and removing the ice crystals so formed.

3. The process according to claim 2, wherein the extract is filtered prior to partially freezing, and the solid matter filtered out is returned to the extract prior to complete freezing.

4. The process according to claim 1, wherein the granulated hard frozen mass is screened, over sized particles being recycled to the extract prior to complete freezing or recycled to the granulating step.

5. The process according to claim 1, wherein the comestible product is orange juice.

6. The process according to claim 5, wherein the step of warming and refreezing the hard frozen mass is repeated between 2 and 8 times.

7. The process according to claim 5, wherein the concentrated orange juice prior to complete freezing has a concentration of 40° to 60° Brix.

8. The process according to claim 7, wherein the orange juice is completely frozen to a temperature of between −60°F to −80°F.

9. The process according to claim 5, wherein the granulated hard frozen mass is vacuum dried under a pressure of less than 100 microns.

10. The process according to claim 9, wherein during vacuum drying the granulated mass is held at a temperature between −20°F and −10°F for a period of 3 to 6 hours, subsequently raised to about 32°F for further 3 to 6 hours, and subsequently raised to 120°F to 140°F for not more than 30 minutes.

* * * * *